US009286867B1

(12) United States Patent
Oliver

(10) Patent No.: US 9,286,867 B1
(45) Date of Patent: Mar. 15, 2016

(54) BUCKET DRUM

(71) Applicant: Eric C. Oliver, Clarksville, IN (US)

(72) Inventor: Eric C. Oliver, Clarksville, IN (US)

( * ) Notice: Subject to any disclaimer, the term of this patent is extended or adjusted under 35 U.S.C. 154(b) by 0 days.

(21) Appl. No.: 14/621,452

(22) Filed: Feb. 13, 2015

Related U.S. Application Data

(60) Provisional application No. 61/940,007, filed on Feb. 14, 2014.

(51) Int. Cl.
*G10D 13/02* (2006.01)

(52) U.S. Cl.
CPC ..... *G10D 13/023* (2013.01); *G10D 13/025* (2013.01); *G10D 13/028* (2013.01); *G10D 13/029* (2013.01)

(58) Field of Classification Search
CPC . G10D 13/023; G10D 13/025; G10D 13/028; G10D 13/029
USPC ..... 84/411 R
See application file for complete search history.

(56) References Cited

U.S. PATENT DOCUMENTS

| | | | | |
|---|---|---|---|---|
| 478,611 | A * | 7/1892 | Knittel | 84/416 |
| 1,031,032 | A * | 7/1912 | Wanamaker | 84/411 R |
| 2,706,925 | A * | 4/1955 | Fendlason, Sr. | 84/413 |
| 6,150,594 | A | 11/2000 | Fiondella et al. | |
| 7,485,791 | B2 | 2/2009 | Takegawa | |
| 7,547,836 | B2 * | 6/2009 | Reed | 84/411 R |
| 7,928,302 | B2 | 4/2011 | Sandson | |

OTHER PUBLICATIONS

Edrums.info; DYI Electronic Drum Tutorials; http://www.edrums.info/bucket_drum_1.htm.

* cited by examiner

*Primary Examiner* — Jianchun Qin
(74) *Attorney, Agent, or Firm* — Middleton Reutlinger; Robert H. Eichenberger; Chad D. Bruggeman

(57) ABSTRACT

Apparatus and methods relating to a drum formed from a bucket, a drum head, and a drum hoop. The drum hoop has a leg that may be undersized relative to the drum head to compress the bucket, and the drum hoop includes attachment portions that may align with attachment portions of the drum head.

19 Claims, 6 Drawing Sheets

BUCKET DRUM

CLAIM OF PRIORITY

This application claims the benefit of U.S. Provisional Application No. 61/940,007, filed Feb. 14, 2014, which is hereby incorporated by reference in its entirety.

CROSS-REFERENCE TO RELATED APPLICATIONS

None.

TECHNICAL FIELD

Generally, a drum formed from a bucket is taught. In particular, a bucket drum having a top hoop attached to a bottom hoop is taught, wherein the bottom hoop forms a compression fit with the bucket and has areas that extend outwardly to align with attachment areas of the top hoop.

BACKGROUND

Musical instruments, including drums, are valuable professional, recreational, and educational devices. However, drums that produce a quality sound are often quite expensive to make or buy. A typical drum may include a drum head, which may include a membrane stretched tightly across an opening of a drum shell. Impact of this tightly stretched membrane, for example by a drumstick or by hand, creates percussive sound. The drum head may also include a top hoop which may retain the membrane in a desired position over the drum shell opening. However, the top hoop typically must be anchored to the drum to secure it in place.

It is often desirable to avoid putting many holes or indentations in the drum shell in order to attach the drum head to the drum shell. Excessive holes or indentations may diminish the quality of the musical tone of the drum. While it is true that some holes or indentations may be formed in a shell without diminishing the quality of the tone, such holes or indentations typically must be sized, shaped, and located very carefully, which can be painstaking and/or expensive. Thus, it is often desirable to simply avoid use of such holes or indentations to attach the drum head to the drum shell.

One method of such attachment involves use of a bottom hoop positioned over the end of the drum shell that is opposite the top hoop. Thus, the top hoop and bottom hoop may straddle the drum shell, may use the drum shell as a foundation for counter balancing forces, and as a result may be attached with a considerable amount of force between them. For example, a bolt or spring may be attached to a top hoop location and a bottom hoop location, and tightened down appropriately, with the forces compressing the drum shell in a longitudinal direction instead of causing holes or indentations in the drum shell.

A plurality of such bolts or springs may be used in various locations around the top hoop and bottom hoop to enhance attachment and distribute the longitudinal compressive forces. Furthermore, tightening or loosening of the bolts or springs may be used to facilitate tuning of the drum head membrane, with tightening or loosening resulting in a corresponding increase or decrease in pitch of the membrane in the area near the respective bolt or spring. Thus, such an arrangement is often desirable to produce a tunable drum head that is part of a drum that produces a rich or high quality sound. However, drum shells are often formed of expensive materials and/or are manufactured with high precision to create a desired tone. Such drum shells are often expensive and, in some cases, may result in the drum being prohibitively expensive, especially for recreational or educational users.

Use of a bucket, such as a five-gallon bucket that one might find at a home improvement store that is used to store a liquid or other materials, has been offered as a way to form a drum shell thus decreasing the cost of a drum. In these cases, the top hoop and bottom hoop may be attached to one another so as to straddle a lip or fin of the bucket. However, doing so generally requires the top and/or bottom hoops to pull all support from the fin. Bucket fins generally are not strong enough or resilient enough to handle the associated forces, and will quickly roll, bend, and/or deform, leading to failure of the fin and thus failure of the bucket as an effective drum shell.

Thus there is a need in the art for overcoming the issues of existing systems.

SUMMARY

The present disclosure is directed toward methods and apparatus for a bucket drum formed from a bucket, such as a typical 5 gallon bucket. A drum head having a top hoop and a membrane are positioned over an open top end of the bucket to create the percussive surface, with the top hoop resting on a surface near the open top end of the bucket. The top hoop is attached to a bottom hoop, with a shell fin of the bucket interposed between the top hoop and the bottom hoop. The bottom hoop has an inner dimension that is undersized relative to an inner dimension of the top hoop, and/or relative to an outer dimension of the bucket or drum shell in order to create a radial compression fit with the drum shell. The undersized inner dimension of the bottom hoop is of an annular ring having a surface that is in face-to-face relation with an outer surface of the drum shell in order to distribute the radial compressive force over an area of the drum shell without damaging it. In order to maintain alignment between attachment areas on the bottom hoop and attachment areas on the top hoop, the bottom hoop attachment areas extend outwardly so as to align with the attachment areas of the top hoop.

Generally, in one aspect, a bucket drum is provided comprising a drum shell, a drum head, and a bottom hoop. The drum shell is formed from a bucket that has an open first end. The drum head has a top hoop and a membrane that may be positioned across the open first end of the drum shell to substantially enclose it. The drum head may be supported by a surface of the drum shell that is adjacent the open first end, and the drum head may be affixed to the drum shell by the top hoop. The bottom hoop is dimensioned to substantially surround the perimeter of the drum shell and also to slidably engage the drum shell so that it may slide over the other end of the drum shell. The bottom hoop is removably attachable to the top hoop by attachment members. The bottom hoop also includes a leg having an inner surface that is in face-to-face relationship with an outer surface of a side wall of the drum shell. The inner surface of the leg has sufficient surface area to compress the side wall without damaging it. A plurality of bottom hoop attachment areas extend radially from, and transverse to, the leg. The bottom hoop attachment areas may be aligned with respective top hoop attachment areas. Optionally, the bottom hoop attachment areas may be mated with a bottom lip of the shell fin. A lid of the bucket used to form the drum shell may be used as a practice pad, which may further include a dampening pad located on a surface of the lid. The attachment members may allow tuning of the membrane by tightening or loosening the attachment members. An audible accessory may be operatively connected to the bucket drum, such as a snare attachment in contact with the drum head. At least one connector may be included, and the connector may be attached to a bottom hoop attachment area to allow attachment of an external member, which may be, for example, a shoulder strap, a back strap, and/or a frame. The inner surface of the leg may be directly mateable with the outer surface of the drum shell. A chamfer may be included on an inner diameter of the leg. The drum shell may optionally include a graphic area with a graphic affixed to it or a graphic may be applied directly to the drum shell.

Generally, in another aspect, a drum having a drum shell formed from a bucket, a drum head having a membrane, and a top hoop, is combined with a bottom hoop having an annular vertical leg. The annular vertical leg has a second inner diameter that is smaller than a first inner diameter of the top hoop. The top hoop is tunably attachable to the bottom hoop with removable attachment members. The annular vertical leg has an inner surface that is mateable with an outer surface of the drum shell. The bottom hoop also includes attachment areas extending radially from the vertical leg that may be aligned with top hoop attachment areas. Optionally, in this drum, the vertical leg may at least slightly compress the drum shell. A shell fin of the drum shell may be interposed between the drum head and the bottom hoop, and the bottom hoop attachment areas may be mateable with or against a bottom lip of the shell fin. The vertical leg may include a chamfered edge along the second inner diameter.

Generally, in another aspect, a bottom hoop for a drum formed from a 5-gallon bucket is provided. The bottom hoop comprises an annular leg having an inner vertical surface and a plurality of radially projecting attachment areas. The inner vertical surface of the annular leg is mateable with an outer surface of a side wall of the 5-gallon bucket. Each radially projecting attachment area has a top lateral surface that may be mated with or against a bottom lip of a shell fin of the 5-gallon bucket, and each also may be aligned with a respective top hoop attachment area wherein the top hoop is part of a drum head that includes a membrane. The top hoop encircles a portion of the 5-gallon bucket that is above the shell fin and the vertical leg of the bottom hoop encircles a portion of the 5-gallon bucket that is below the shell fin so that the shell fin is interposed between the top hoop and the bottom hoop. Optionally, each bottom hoop attachment area may include at least one hole for attachment to each respective top hoop attachment area via a bolt, which may be used to tune the drum.

It should be appreciated that all combinations of the foregoing concepts and additional concepts discussed in greater detail below provided such concepts are not mutually inconsistent are contemplated as being part of the subject matter disclosed herein. In particular, all combinations of claimed subject matter appearing at the end of this disclosure are contemplated as being part of the subject matter disclosed herein.

BRIEF DESCRIPTION OF THE DRAWINGS

In the drawings, like reference characters generally refer to the same parts throughout the different views. Also, the drawings are not necessarily to scale, and emphasis instead is generally placed upon illustrating the principles of the embodiments depicted.

DETAILED DESCRIPTION

Figure 1:
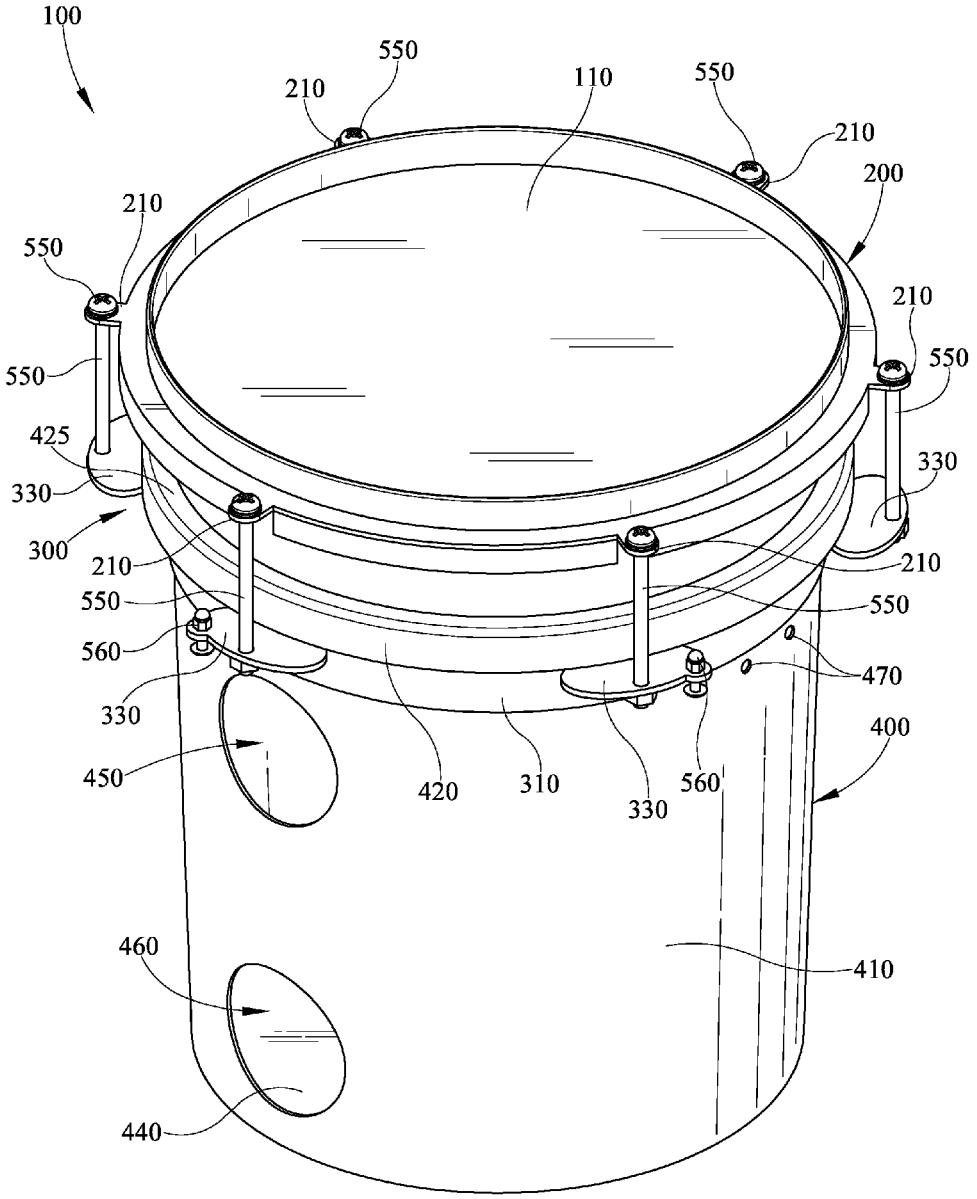
FIG. 1 is a perspective view of an embodiment of a bucket drum.

It is to be understood that the embodiments are not limited in their application to the details of construction and the arrangement of components set forth in the following description or illustrated in the drawings. Other embodiments are possible and may be practiced or carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected" and "coupled" and variations thereof herein are used broadly and encompass direct and indirect connections and couplings. In addition, the terms "connected" and "coupled" and variations thereof are not restricted to physical or mechanical connections or couplings.

Figure 2:
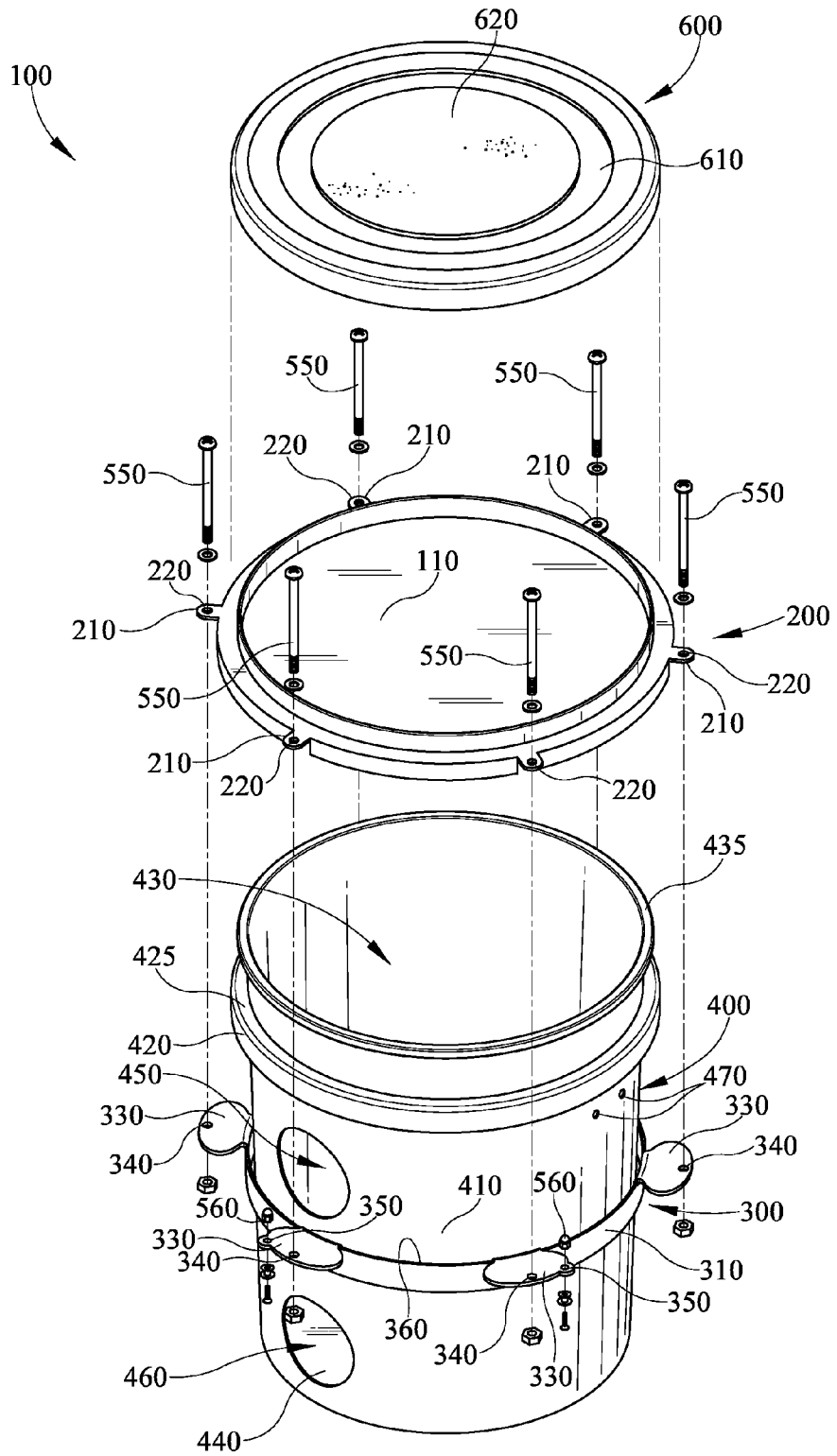
FIG. 2 is an exploded perspective view of the bucket drum of FIG. 1.
Figure 3:
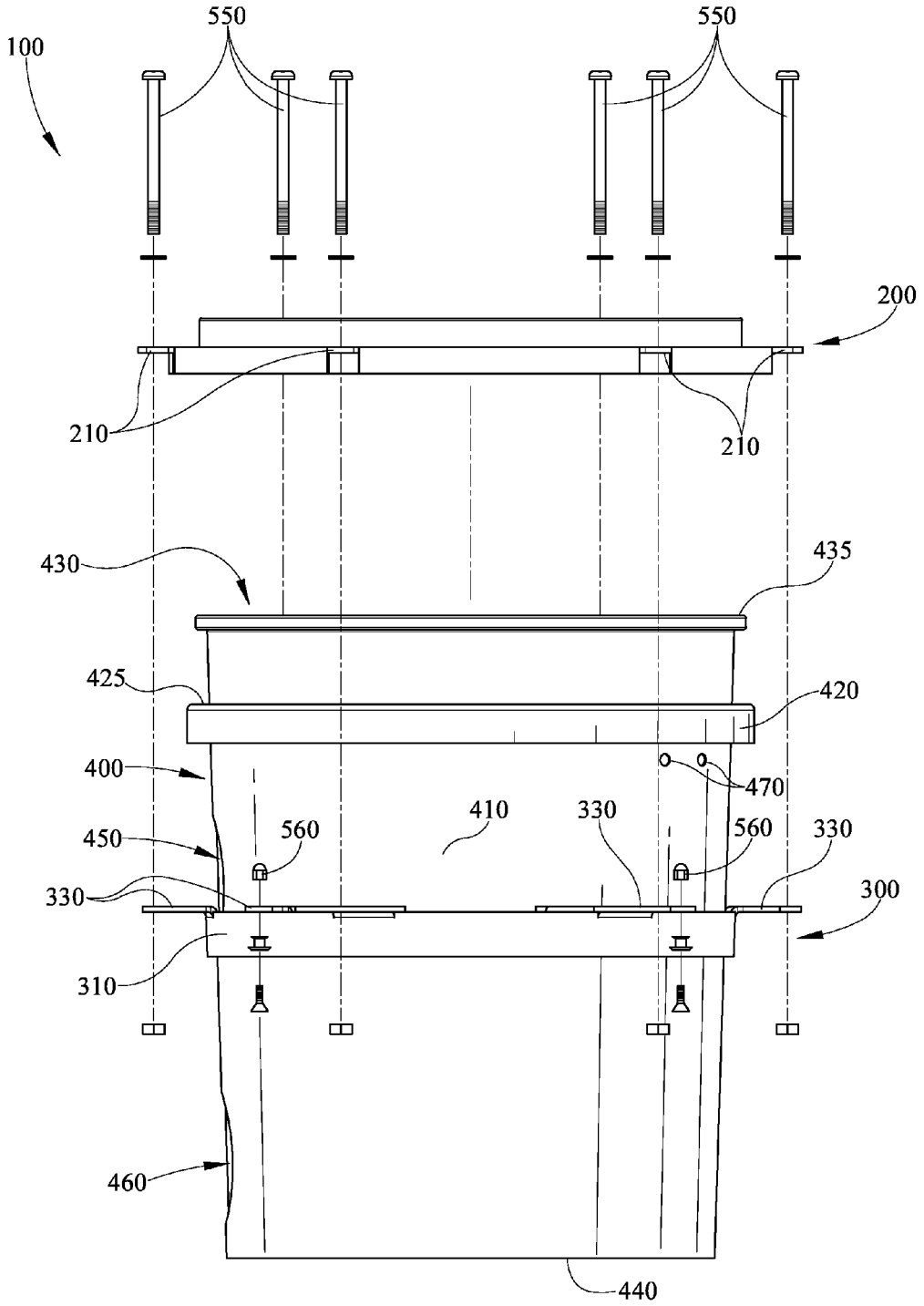
FIG. 3 is an exploded elevation view of the bucket drum of FIGS. 1 and 2.

Referring initially to FIGS. 1-3, a bucket drum 100 is illustrated as it may, in some embodiments, be formed from a bucket 400. Bucket drum 100 may include a membrane 110 positioned or positionable over an open top or first end 430 of bucket 400. Membrane 110 may be held in a desired position substantially covering open first end 430 by a top hoop 200 (membrane 110 and top hoop 200 may collectively form a drum head or, alternatively, membrane 110 may be considered an optional but inclusive feature of top hoop 200 as referred to herein). Top hoop 200 may rest on, be supported by, or be positioned on a top lip 435 of bucket 400. A bottom hoop 300 may encircle or surround an outer perimeter of a side wall 410 of bucket 400 and/or slidably engage bucket 400, and/or be slid into position, such as, for example, adjacent to and/or abutting a bottom lip 426 (see FIG. 6) of shell fin 420. Top hoop 200 and bottom hoop 300 may be attached, connected, or fastened together with shell fin 420 interposing and/or supporting either or both of top hoop 200 and bottom hoop 300.

Bottom hoop 300 may have a leg 310 that may be a substantially annular ring having a substantially vertical inner surface 315 (see FIG. 6), which may be mateable with, parallel to, in face-to-face relationship or contact with, and/or flush with an outer surface of bucket side wall 410. The inner diameter of leg 310 may be slightly undersized relative to the outer diameter of bucket side wall 410 to form a compression or friction fit in a radial direction. In this way, side wall 410 may help support top hoop 200, bottom hoop 300, and/or membrane 110 to reduce the amount of force carried by shell fin 420, which may become deformed and/or break if required to support too much force, which may be associated with attachment of top hoop 200 and bottom hoop 300. The vertical inner surface 315 of leg 310 may act to distribute the radial compressive force over a corresponding area of bucket side wall 410, thus the pressure (e.g., measured in pounds per square inch) on the side wall 410 may be reduced by increasing the area of leg 310 that mates with, is in face-to-face relationship with, and/or is substantially parallel to, side wall 410. If such area of leg 310 is small, as may be the case with a short vertical inner surface 315, the pressure on side wall 410 will be high, which may result in damage or destruction of side wall 410 or excessive deformation or bending of top lip 435. It is understood that in some embodiments the leg 310 does not need to directly contact the side wall 410, and may cause radial compression of side wall 410 indirectly via, for example, a spacer or shim inserted between leg 310 and side wall 410. Such a spacer or shim may facilitate, for example, use of a given bottom hoop 300 and/or leg 310 with a bucket that is smaller than bucket 400 and/or has an outer diameter smaller than the inner diameter of leg 310, as shown in the figures.

Top hoop 200 may have a first inner dimension or diameter, across which membrane 110 is positioned, that is dimensioned relative to the dimensions or diameter of bucket open first end 430 so that membrane 110 may entirely cover open first end 430. Because bottom hoop 300 and/or leg 310 is undersized relative to bucket 400, either or both of bottom hoop 300 and leg 310 may have a second inner dimension or diameter that is smaller than the first inner dimension or diameter of top hoop 200. The difference between the first inner dimension of top hoop 200 and the second inner dimension of bottom hoop 300 may be increased in some embodiments wherein bucket 400 is conical and/or has a decreasing or tapering diameter or dimension from first end 430 to a bottom end or panel 440. In some embodiments, it has been found that a 12" drum head works effectively with many 5 gallon buckets. However, in these or other embodiments, use of a 12" bottom hoop 300 places too much strain on the bucket fin or shell fin 420. Thus, in these or other embodiments, it may be helpful to provide a bottom hoop 300 having an undersized inner diameter (e.g. 11") relative to the bucket 400 to form a radial compression fit with the bucket 400. The radial compression force may absorb some of the force required to support top hoop 200 and/or bottom hoop 300, and/or reduce the amount of force supported by the shell fin 420.

Attachment members, such as bolts 550, may be used to attach top hoop 200 to bottom hoop 300. For example, top hoop 200 may have top hoop attachment areas 210 and bottom hoop 300 may have bottom hoop attachment areas 330. Each top hoop attachment 210 area may have a top bolt hole 220 through which bolt 550 may be inserted. Each bottom hoop attachment area 330 may have a bottom bolt hole 340 through which bolt 550 may be inserted. In order to facilitate insertion of bolt 550 through respective top bolt hole 220 and bottom bolt hole 340, top bolt hole 220 and bottom bolt hole 340 may be aligned vertically and/or longitudinally along bolt 550. Because, bottom hoop 300 may have a leg 310 having an inner dimension or diameter that is smaller than an inner dimension or diameter of top hoop 200 as discussed above, bottom hoop attachment areas 330 may extend radially and/or outwardly from leg 310 a distance great enough to align bottom bolt holes 340 with top bolt holes 220. Either or both of top bolt holes 220 and bottom bolt holes 340 may be through-holes and/or may be threaded. If threaded, a nut may not be required for use of bolt 550, although it is understood that either or both of top bolt holes 220 and bottom bolt holes 340 may be other than threaded and/or a nut may be used to facilitate attachment.

Figure 4:
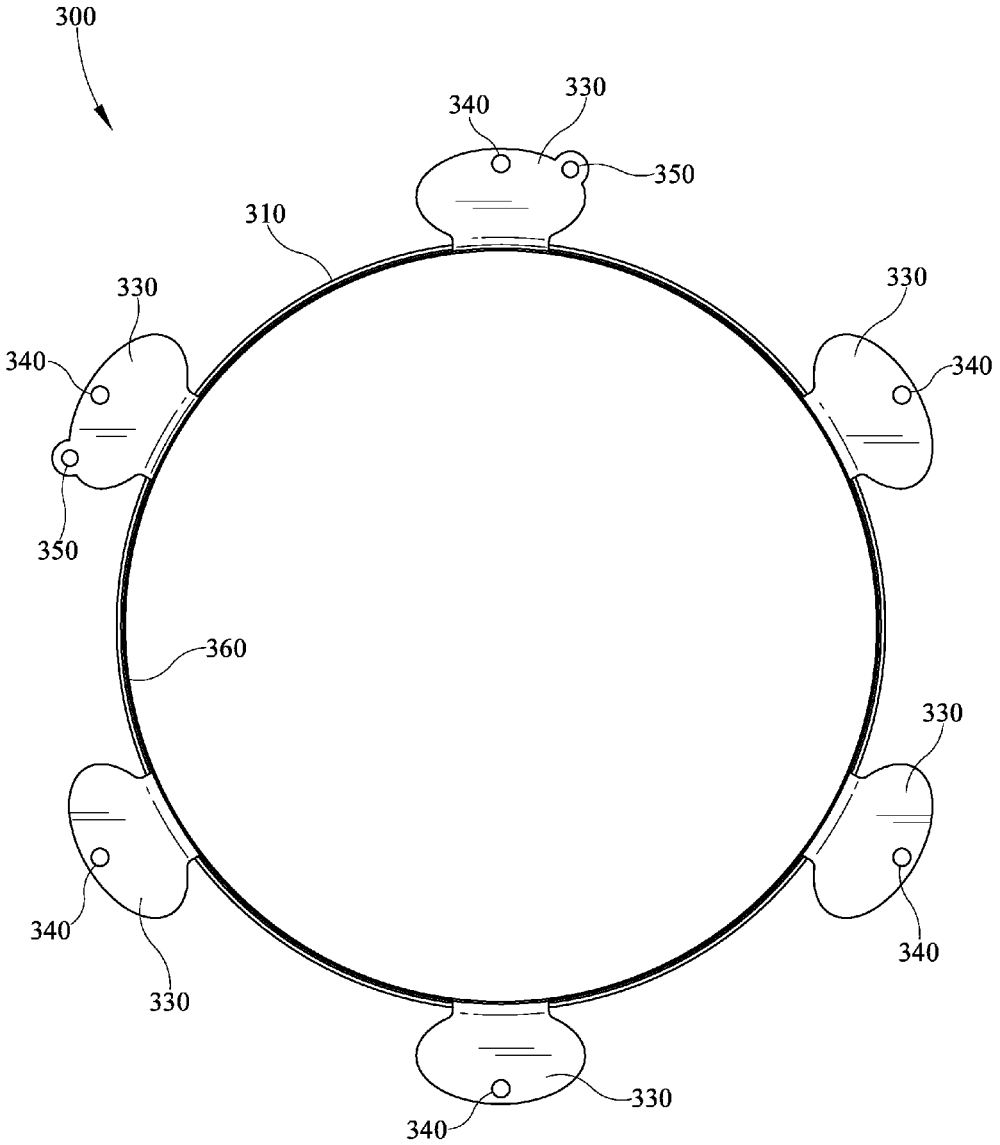
FIG. 4 is a top view of an embodiment of a bottom hoop for a bucket drum.
Figure 5:
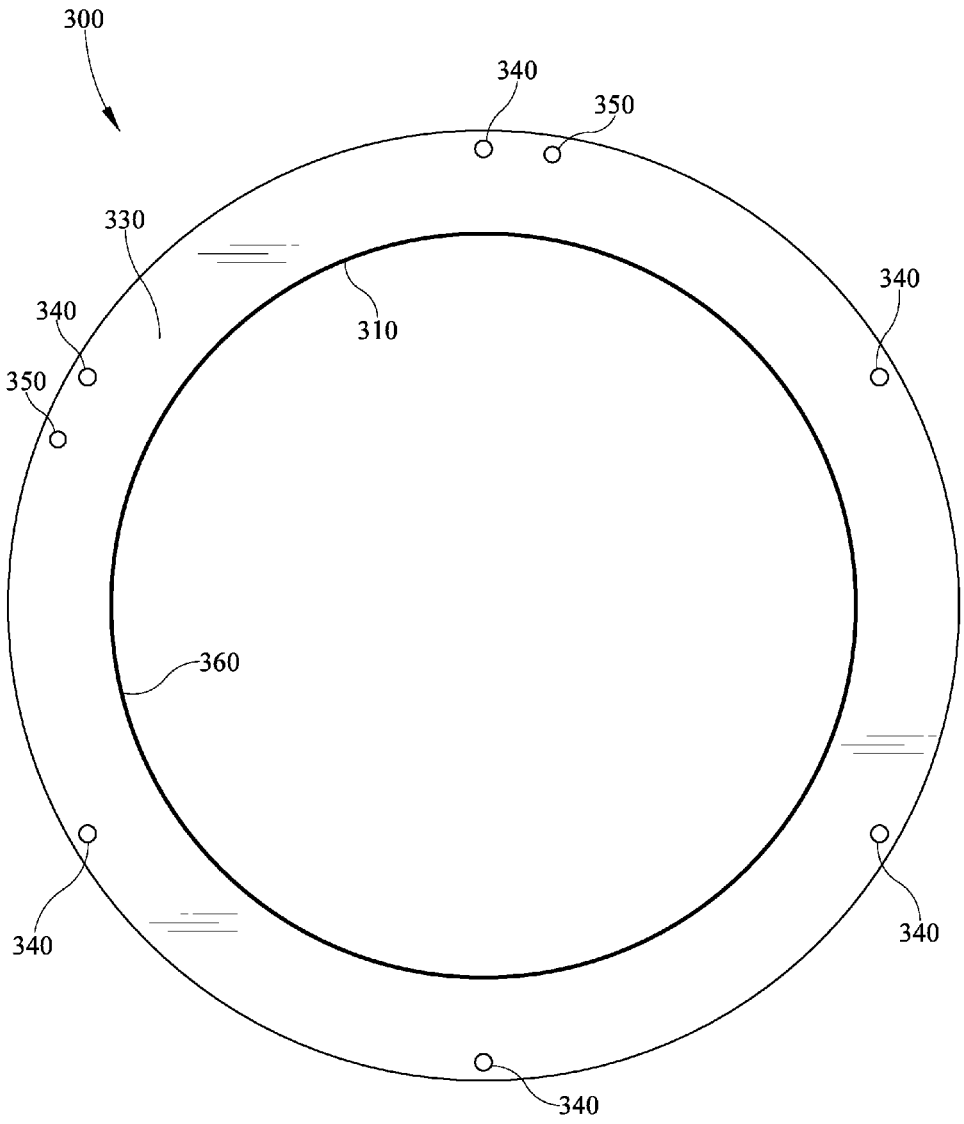
FIG. 5 is a top view of an alternative embodiment of a bottom hoop for a bucket drum.

Shell fin 420 may be an outwardly and/or radially extending projection from bucket 400, as is often found on conventional buckets, such as any of a variety of conventional 5-gallon buckets. Alternatively, shell fin 420 may be added to bucket 400 by any of a variety of attachment mechanisms, including, but not limited to, gluing, welding, nailing, screwing, bolting, bonding, adhering, otherwise attaching or connecting, or any combination thereof. Bottom hoop 300 may have attachment areas 330 that extend outwardly and/or radially from leg 310. Attachment areas 330 may have an upper and/or lateral surface that is parallel to, flush with, and/or mateable with bottom lip 426 (see FIG. 6) of shell fin 420, such as, for example, in face-to-face relationship and/or contact. Bottom hoop 300 and/or leg 310 may include a chamfer 360 at or near an inner dimension or diameter thereof. Chamfer 360, if included, may be used to facilitate applying epoxy, adhesive, resin, or any other bonding or attachment feature, or a combination thereof, which may be used to bond or attach bottom hoop 300 to bucket 400, side wall 410, shell fin 420, and/or shell fin bottom lip 426. Chamfer 360 may be formed in any of a variety of ways, including, but not limited to, machining, cutting, molding, being a rounded area resulting from bending attachment areas 330 (e.g. tab-like or flange-like as illustrated in FIGS. 4 and 5, respectively) outwardly from leg 310, or any other way or any combination thereof.

Although illustrated as resting on a top lip 435 of bucket 400, wherein top lip 435 is an outwardly or radially projecting lip near open first end 430, it is understood that top lip 435 is not required in some embodiments. Top lip 435 may be integrally formed with bucket 400 or, alternatively, may be added to bucket 400 by any of a variety of attachment mechanisms, including, but not limited to, gluing, welding, nailing, screwing, bolting, bonding, adhering, otherwise attaching or connecting, or any combination thereof. Alternatively, top hoop 200 may rest on a top surface 425 of shell fin 420, as may be the case, for example, in embodiments wherein bucket 400 does not have a separate top lip 435 as shown in FIGS. 1-3 and 6.

A top hole 450 and/or a bottom hole 460 may be formed in bucket 400 and/or side wall 410 to, for example, enhance or improve the sound quality, facilitate inclusion of a microphone on or in bucket drum 100, to equalize air pressure of ambient air to air within bucket drum 100, to provide a pathway for air inside the drum to escape the drum upon a user striking the membrane 110, or for any other reason. In this manner, the holes 450, 460 allow for the production of sound without requiring side wall 410 to excessively expand. Either or both of top hole 450 and bottom hole 460 may be included and may be sized, shaped, and/or positioned in any of a variety of ways. For example, either or both of top hole 450 and bottom hole 460 may be round, circular, oval, triangular, rectangular, square, free-form, or any other shape or any combination thereof, and each may be shaped independently of the shape of the other; either or both may be large, small, medium sized, or any size, and may be sized independently of the size of the other; and/or either or both may be positioned side by side, vertically, at an angle, or in any other orientation, and each may be positioned independently of the placement of the other. Furthermore, it is understood that only one hole may be included, two holes may be included, or more than two holes may be included and, regardless of the number of holes, any or all of them may be sized, shaped, and/or positioned in any of a variety of ways, such as those mentioned above, and/or independently of any or all others. It is further understood that varying the size, shape, position, and/or number of holes, such as top hole 450 and bottom hole 460, for example, may vary the pitch, tone, and/or sound of bucket drum 100. Further still, it is understood that none of holes 450, 460, 470 or any other hole are required, and that, in some embodiments, bucket drum 100 may be substantially without holes and/or the inside of bucket drum 100 may be substantially sealed off from the environment.

Bucket drum 100 may be provided without bottom panel 440. For example, bucket 400 may be provided as substantially bottomless and/or having an opening in or near a bottom portion or, alternatively, bottom panel 440 may be cut or removed from bucket 400 to form an open bottom end. Removing or modifying bottom panel 440 may vary the pitch, tone, and/or sound of bucket drum 100. Moreover, bucket 400 and/or side wall 410 may be cut at any of a variety of locations to shorten bucket drum 100 and/or cause an open bottom end of bucket 400. For example, cutting side wall 410 higher, or nearer shell fin 420, may create a higher pitch than if side wall 410 were cut lower, or further from shell fin 420.

One or more pressure relief holes 470 may be included to, for example, relieve pressure that may build up within or outside bucket 400, especially in embodiments wherein bucket 400, including bottom panel 440, and/or drum membrane 110 form a substantially enclosed container that inhibits or prohibits air from entering or exiting bucket 400. Although it is understood that pressure relief holes 470 are not required, without pressure relief holes 470, top hole 450, bottom hole 460, and/or an opening in or instead of bottom panel 440, changes in temperature may result in sufficiently high pressure differentials between the air within bucket 400 and the environment that could potentially damage or destroy bucket drum 100 and/or membrane 110. For example, on cold days, air within bucket drum 100 may compress and membrane 110 may be sucked in, and/or on hot days, air within bucket drum 100 may expand and membrane 110 may be pushed out, either or both of which may damage membrane 110 and/or cause membrane 110 to become out of tune. In some embodiments, pressure relief holes 470 may be sized and/or shaped so as to be large enough to not be easily obstructed by debris and/or small enough to prevent side wall 410 from excessively expanding when bucket drum 100 is being played. For example, in some embodiments, pressure relief hole or holes 470 may be approximately round and/or approximately ⅛" in diameter.

Open first end 430 may be formed by removing lid 600 from the first end 430 of bucket 400 or, alternatively, by cutting away a top side or panel of bucket 400 if there is such a feature, and this feature may be formed into lid 600. It is understood, however, that in some embodiments a bucket 400 may be provided without lid 600 or a top panel, and/or bucket 400 may be provided with an already open first end 430. In some embodiments, a practice pad 620 may be applied to a surface of lid 600, such as inside surface 610. If included, practice pad 620 may be made of a soft or spongy material so that, for example, a user can practice on it without making as much noise as would be made if contacting membrane 110.

Bucket 400 and/or side wall 410 may have a graphic area, which may have a graphic affixed thereto. If included, the graphic may be any of a variety of graphics, including, but not limited to, pictures, words, symbols, art work, drawings, visual representations, braille, or any other graphic, or any combination thereof. The graphic may be affixed or applied to bucket 400 and/or side wall 410 by any of a variety of methods, including, but not limited to, painting, drawing, sketching, screen printing, sticking, gluing, airbrushing, spray painting, silk screening, or any other method of affixation or application, or any combination thereof. For example, in some embodiments, a separate printable material or medium may be affixed to an outer surface of side wall 410 by printing it in a flat orientation and applying it to side wall 410 to match the shape and/or size of side wall 410 and/or bucket 400. If side wall 410 tapers, then the printable material or medium may be cut or otherwise modified (e.g. either or both ends cut at an angle) so that it will match the profile, shape, and/or size of side wall 410. If included, the printable material or medium may be peel-and-stick, adhesive, glue on, static cling, or applicable to side wall 410 in any other way. If included, the printable material or medium may be interposed between side wall 410 and bottom hoop 300, which may facilitate retention, but it is not so required. It is understood that a separate printable material or medium is not required and, in some embodiments, a graphic may be applied directly to bucket 400 or, alternatively, bucket drum 100 may be substantially without a graphic and/or graphic area.

Referring now to FIGS. 4 and 5, alternative embodiments of bottom hoop 300 are illustrated. FIG. 4 illustrates bottom hoop 300 having a plurality of separated attachment areas 330 each having a bottom bolt hole 340, which may be used to accept bolt 550 and/or for attachment to top hoop 200, as discussed above. Attachment areas 330 may be substantially tab-like as shown in FIG. 4, although they are not required to be tab-like. Attachment areas 330 may be attached to and/or formed integrally with leg 310 and/or the rest of bottom hoop 300, or could be formed separately and then attached to leg 310. FIG. 5 illustrates attachment area 330 as a substantially annular ring or flange projecting outwardly or radially from leg 310 and encircling leg 310.

Although six attachment areas 330 are illustrated in FIGS. 4 and 5 as substantially symmetrically positioned, it is understood that any number of attachment areas 330 may be used, including a single continuous ledge, and bolt holes 340 may be positioned in any of a variety of ways, whether symmetrically or asymmetrically. It is further understood that any or all attachment portions 330 may include one or more bottom bolt holes 340, and are not limited to one bottom bolt hole 340 per attachment area 330 as shown in FIGS. 4 and 5. FIGS. 4 and 5 merely illustrate two exemplary embodiments of bottom hoop 300. Any or all of attachment areas 330 may include one or more connector holes 350. If included, connector holes 350 may allow connection of an external element, such as a shoulder strap, back strap, or frame which may facilitate carrying of bucket drum 100. An exemplary frame, if included, may hold one or more bucket drums 100 and/or any of a variety of other drums, instruments, and/or devices in a desired orientation. For example, a frame may be used to hold two or more bucket drums 100 (e.g. each having a different pitch or sound) rigidly side-by-side in a horizontal orientation to facilitate playing by a user, which may be, for example, a member of a marching band. Connector 560 may be inserted through connector holes 350 and tightened down, giving one or more attachment locations for an external element, such as a shoulder or a back strap. In some embodiments, connector 560 may be a drum strap or guitar strap peg.

Figure 6:
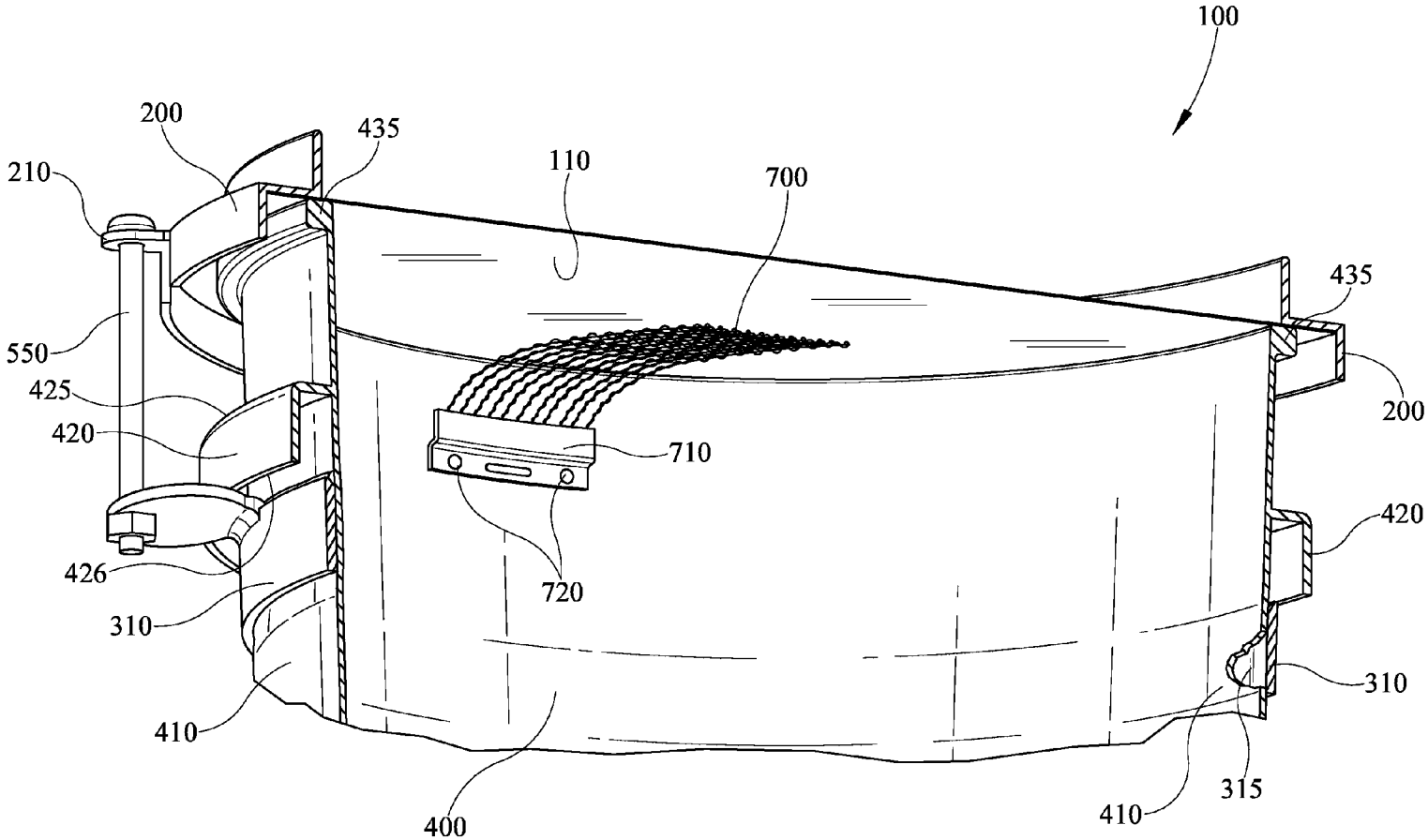
FIG. 6 is a perspective section view of a bucket drum having a snare attachment.

In FIG. 6 an embodiment of a bucket drum 100 is illustrated including a snare attachment 700, a snare bracket 710, and snare rivets 720. Snare attachment 700 may be included to create a snare sound when membrane 110 is percussively struck by, for example, a drum stick or hand. Snare bracket 710 may be used to hold snare attachment 700 in position with respect to bucket 400 and/or side wall 410. Snare bracket 710 may be curved or arcuate to match the curved side wall 410, or otherwise correspondingly formed to match the profile of side wall 410 if side wall 410 is other than cylindrical, conical, or round. Thus, snare bracket 710 may be made or formed so that it may be positioned flat or flush with an inside surface of side wall 410, as shown in FIG. 6. Snare rivets 720 may be used to attach, secure, and/or fasten snare bracket 710 and/or snare attachment 700 to side wall 410 and/or bucket 400. It is understand that, although snare rivets 720 are shown attaching snare bracket 710 to side wall 410, any of a variety of attachment mechanisms may be used for this purpose, for example, gluing, welding, nailing, screwing, bolting, bonding, adhering, otherwise attaching or connecting, or any combination of these mechanisms may be used. It is understood that any of a variety of musical, audible, aural, or other devices or accessories may be used instead of or in addition to snare attachment 700 such as, for example, tambourine cymbals, guitar strings (which may be positioned across an inside surface of membrane 110), jingle bells, or any other device or any combination thereof.

Any of a variety of materials may be used to make, form, or construct any or all of bucket 400, top hoop 200, bottom hoop 300, bolt 550, lid 600, snare 700, or any feature associated therewith, or any other feature of bucket drum 100. For example, bucket 400 may be metal, wood, rubber, plastic, any other material, or any combination thereof. However, it has been found that, in an exemplary embodiment, a 70 mil 5 gallon bucket, model SE, provided by the Encore Plastics Corp. of Cambridge, Ohio (which may include lid 600 to which practice pad 620 may be applied) is sufficiently resilient and provides a high quality tone when used with a 12" drum head (including membrane 110 and top hoop 200). In this or any other exemplary embodiment, bottom hoop 300 may be formed of a metal strip (such as steel, iron, or aluminum, for example) or any other sufficiently resilient material such as, for example, carbon fiber, plastic, wood, rubber, or any other material or combination thereof. The strip may have a height at least partially defining the vertical inner surface 315 of leg 310. If used, this metal strip may have vertical tab-like projections that may be bent radially and/or outwardly relative to leg 310 to form tab-like attachment areas 330 (such as those shown in FIGS. 1-4 and 6). Continuing this example, the metal strip may be bent to form an annular ring and the ends of the metal strip may be welded to retain the annular shape, forming leg 310 having attachment areas 330. If desired, leg 310 and/or attachment areas 330 may be powder coated, chromed, and/or otherwise formed, coated, or painted to, for example, enhance weather resistant and/or corrosion resistant properties of any or all portions of bottom hoop 300.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The foregoing description of several methods and embodiments have been presented for purposes of illustration. It is not intended to be exhaustive or to limit the precise steps and/or forms disclosed, and obviously many modifications and variations are possible in light of the above teaching. It is intended that the scope and all equivalents be defined by the claims appended hereto.

What is claimed is:

1. A bucket drum, comprising:

a drum shell formed from a bucket having a side wall extending between an open first end and an opposing second end, and a shell fin adjacent said open first end projecting radially outwardly from said side wall;

a drum head having a top hoop and a membrane positionable across said open first end of said drum shell and substantially enclosing said open first end, said drum head supportable by a surface adjacent said first end of said drum shell and affixable to said drum shell by said top hoop, said top hoop having a plurality of top hoop attachment areas;

a bottom hoop dimensioned to substantially surround an outer perimeter of the drum shell and slidably engageable therewith to slide over said second end of said drum shell opposite said open first end, said bottom hoop is spaced away from said second end of said drum shell towards said open first end in an abutting position with said shell fin;

wherein said bottom hoop is removably attachable to said top hoop by attachment members;

wherein said bottom hoop includes a leg having an inner surface, and said bottom hoop includes a plurality of bottom hoop attachment areas extending radially outwardly from said leg;

when said bottom hoop is in said abutting position with said shell fin, said inner surface of said leg is in a 360 degree circumferential face-to-face relationship with an outer surface of said side wall of said drum shell, wherein said outer surface of said drum shell side wall has a first diameter and said inner surface of said leg has a second diameter, and wherein said second diameter is smaller than said first diameter to compress said side wall of the drum shell; and wherein each of said bottom hoop attachment areas is substantially alignable with at least one of said plurality of top hoop attachment areas.

2. The bucket drum of claim 1, wherein said bottom hoop attachment areas are mateable with a bottom lip of said shell fin of said drum shell.

3. The bucket drum of claim 1, wherein said attachment members allow tuning of said membrane by at least one of tightening and loosening said attachment members.

4. The bucket drum of claim 1, further comprising an audible accessory operatively connected to said bucket drum.

5. The bucket drum of claim 4, wherein said audible accessory includes a snare attachment attached to an internal surface of said drum shell external wall, said snare attachment in contact with said drum head.

6. The bucket drum of claim 1, further comprising at least one connector attachable to at least one of said plurality of bottom hoop attachment areas to allow attachment of an external member.

7. The bucket drum of claim 6, wherein said external member is at least one of a shoulder strap, a back strap, and a frame.

8. The bucket drum of claim 1, wherein said inner surface of said leg is directly mateable with said outer surface of said drum shell.

9. The bucket drum of claim 1, further comprising a chamfer on an inner diameter of said leg.

10. The bucket drum of claim 1, wherein said drum shell includes a graphic area with a graphic affixed thereto.

11. The bucket drum of claim 1, wherein said inner surface of said leg has sufficient surface area to not damage said side wall of said drum shell.

12. In a drum of the class wherein a drum shell is formed from a bucket, comprising: wherein the drum includes a drum head having a membrane and a top hoop having a first inner diameter, said top hoop tunably attachable to a bottom hoop with removable attachment members, wherein said bottom hoop is spaced away from a bottom end of said drum shell towards said top hoop, the combination with said bottom hoop of an annular vertical leg having an inner surface, and an adhesive, wherein said adhesive mates said inner surface of said annular vertical leg with an outer surface of said drum shell formed from a bucket, wherein said vertical leg includes a second inner diameter that is smaller than said first inner diameter of said top hoop, and wherein said bottom hoop includes a plurality of attachment areas extending radially from said vertical leg that are alignable with each of a plurality of top hoop attachment areas.

13. In the drum of claim 12, said vertical leg at least slightly compressing said drum shell.

14. In the drum of claim 12, wherein a shell fin of said drum shell is interposed between said drum head and said bottom hoop.

15. In the drum of claim 12, said plurality of attachment areas of said bottom hoop mateable with a bottom lip of said shell fin.

16. In the drum of claim 12, said vertical leg including a chamfered edge along said second inner diameter, wherein said chamfered edge receives said adhesive.

17. A bottom hoop for a drum formed from a 5-gallon bucket, comprising:

an annular leg having an inner vertical surface mateable with an outer surface of a side wall of the 5-gallon bucket;

a plurality of radially projecting attachment areas, each attachment area of said plurality of radially projecting attachment areas having a top lateral surface mateable with a bottom lip of a shell fin of the 5-gallon bucket;

wherein each attachment area of said plurality of attachment areas is alignable with a respective top hoop attachment area of a top hoop, said top hoop being a part of a drum head including said top hoop and a membrane; and wherein said top hoop encircles a portion of said 5-gallon bucket above said shell fin and said vertical leg of the bottom hoop encircles a portion of said 5-gallon bucket below said shell fin and wherein the bottom hoop is spaced away from a bottom end of said 5-gallon bucket towards said top hoop, said shell fin interposed between said top hoop and the bottom hoop.

18. The bottom hoop of claim 17, wherein each bottom hoop attachment area includes at least one hole for attachment to each top hoop attachment area via a bolt.

19. The bottom hoop of claim 18, wherein each of said top hoop attachment areas is tunably attachable to each of said bottom hoop attachment areas by a tunable attachment member.

* * * * *